US006336620B1

(12) United States Patent
Belli

(10) Patent No.: US 6,336,620 B1
(45) Date of Patent: Jan. 8, 2002

(54) BRACKETS FOR RETAINING POST AND BOARD ENDS

(76) Inventor: John A. Belli, 190 Will Thompson Way, Fitchburg, MA (US) 01420

( * ) Notice: Subject to any disclaimer, the term of this patent is extended or adjusted under 35 U.S.C. 154(b) by 0 days.

(21) Appl. No.: 09/565,325

(22) Filed: May 5, 2000

Related U.S. Application Data

(63) Continuation of application No. 08/815,491, filed on Mar. 11, 1997, now abandoned.

(60) Provisional application No. 60/013,123, filed on Mar. 11, 1996, and provisional application No. 60/039,642, filed on Feb. 24, 1997.

(51) Int. Cl.[7] ..... F16M 13/00

(52) U.S. Cl. ..... 248/519; 248/523; 248/346.01; 52/296

(58) Field of Search ..... 248/519, 523, 248/530, 527, 357, 903, 346.01; 52/736.1, 736.3, 736.4, 738.1, 296, 297, 298, 301, 302.5, 293

(56) References Cited

U.S. PATENT DOCUMENTS 697,310 A * 4/1902 Younglove ..... 52/302.5
769,976 A * 9/1904 Zimmermann ..... 52/302.5
900,517 A * 10/1908 Glover ..... 52/302.5
910,765 A * 1/1909 Adelman ..... 52/302.5
2,820,262 A * 1/1958 Dunn ..... 52/302.5
3,563,502 A * 2/1971 Dayson ..... 248/44
3,630,474 A * 12/1971 Minor ..... 248/158
3,809,346 A * 5/1974 Jackson ..... 248/44
4,048,776 A * 9/1977 Sato ..... 52/297
4,381,160 A * 4/1983 Grimm et al. ..... 403/230
4,429,497 A * 2/1984 Dibernardi ..... 52/27
4,824,136 A * 4/1989 Bobby ..... 280/475
5,143,472 A * 9/1992 Reed et al. ..... 403/230
5,263,297 A * 11/1993 Kim ..... 52/724
5,381,636 A * 1/1995 Kassardijian et al. ..... 52/301
5,392,575 A * 2/1995 Hoffman et al. ..... 52/299
5,478,042 A * 12/1995 Bliss et al. ..... 248/523
5,568,909 A * 10/1996 Timko ..... 248/519
5,580,026 A * 12/1996 Newcomer ..... 248/523

* cited by examiner

*Primary Examiner*—Anita King
*Assistant Examiner*—Kimberly Wood
(74) *Attorney, Agent, or Firm*—Pandiscio & Pandiscio

(57) ABSTRACT

A bracket for mounting on a surface and for retaining an end of an elongated object, wherein the bracket includes a flange portion for connection to the surface, and a tubular wall portion extending from the flange portion and having an open end for receiving the end of the elongated object, the tubular wall portion being continuous and endless circumferentially of the tubular wall portion for completely surrounding the end of the elongated object.

14 Claims, 13 Drawing Sheets

BRACKETS FOR RETAINING POST AND BOARD ENDS

REFERENCE TO PENDING PRIOR PATENT APPLICATION

This is a continuation of prior U.S. patent application Ser. No. 08/815,491, filed Mar. 11, 1997 abandoned, by John A. Belli for BRACKETS FOR RETAINING POST AND BOARD ENDS, which in turn claimed benefit of prior U.S. Provisional Patent Application Serial No. 60/013,123, filed Mar. 11, 1996 by John A. Belli for SURFACE MOUNT FLANGES, and prior U.S. Provisional Patent Application Serial No. 60/039,642, filed Feb. 24, 1997 by John A. Belli for FLANGES. The specification and drawings of which are hereby also incorporated herein by reference.

FIELD OF THE INVENTION

This invention relates to bracket devices for mounting objects, such as posts or boards, to surfaces of support members for such objects.

BACKGROUND OF THE INVENTION

It often is desirable to mount a rail or board to a post, or to mount a post or board to a flat surface. Unfortunately, in many situations, this can be inconvenient or difficult to accomplish. For example, in post and rail fences, holes in the posts are adapted to receive the ends of the rails. The holes are spaced a standard distance apart on the posts. However, sometimes it is desirable to vary the distance between the rails. Further, replacement of broken rails can be difficult, particularly where the pair of supporting posts are securely mounted in the ground and where other good rails are still retained by the posts. In this situation it can be difficult to remove the bad rail and even more difficult to position a replacement rail.

Further, it often is desired to mount a post on a horizontal surface, such as, for example, a railing post on a wooden deck, the legs of equipment such as swings and other children's play devices on a concrete surface, the posts of swimming ladders on concrete decks, and fence posts on rock ledge, to mention only a few of the many possible post-to-surface mounting situations.

OBJECTS OF THE INVENTION

Accordingly, an object of the present invention is to provide devices by which a post or board or rail may be mounted on a surface which is horizontal, vertical, or inclined.

A further object of the present invention is to provide an improved method for quickly and easily mounting a post, board, or rail on a surface.

SUMMARY OF THE INVENTION

These and other objects of the present invention are addressed by the provision and use of a novel bracket for mounting on a surface and for retaining an end of an elongated object, the bracket comprising a flange portion for connection to the surface, and a tubular wall portion extending from the flange portion and having an open end for receiving the end of the elongated object, the tubular wall portion being continuous and endless circumferentially of the tubular wall portion for completely surrounding the end of the elongated object.

The objects of the present invention are further addressed by the provision and use of a method for mounting an elongated object on a surface, the method comprising the steps of: providing a bracket comprising a flange portion, and a tubular wall portion extending from the flange portion, the tubular wall portion having an open end for receiving an end of the elongated object and being continuous and endless circumferentially of the tubular wall portion for completely surrounding the end of the elongated object; and fixing the flange portion of the bracket to the surface and inserting the end of the elongated object through the open end of the tubular wall portion into a space defined by the tubular wall portion, whereby to mount the elongated object on the surface.

BRIEF DESCRIPTION OF THE DRAWINGS

These and other objects and features of the present invention will be more fully disclosed or rendered obvious by the following detailed description of the preferred embodiments of the invention, which are to be considered together with the accompanying drawings wherein like numbers refer to like parts, and further wherein.

DETAILED DESCRIPTION OF THE INVENTION

This patent application claims benefit of pending prior U.S. Provisional Patent Application Serial No. 60/013,123, filed Mar. 11, 1996 by John A. Belli for SURFACE MOUNT FLANGES, the specification and drawings of which are hereby incorporated herein by reference; and pending prior U.S. Provisional Patent Application Serial No. 60/013,123, filed Feb. 24, 1997 by John A. Belli for FLANGES, the specification and drawings of which are hereby also incorporated herein by reference.

Figure 2:
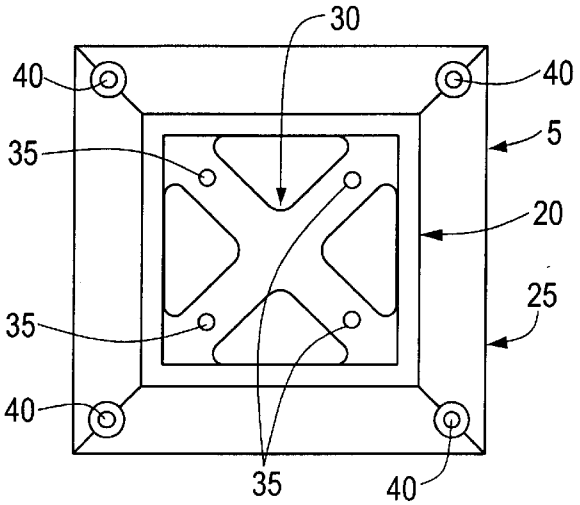
FIG. 2 is a top plan view of the bracket shown in FIG. 1.
Figure 3:
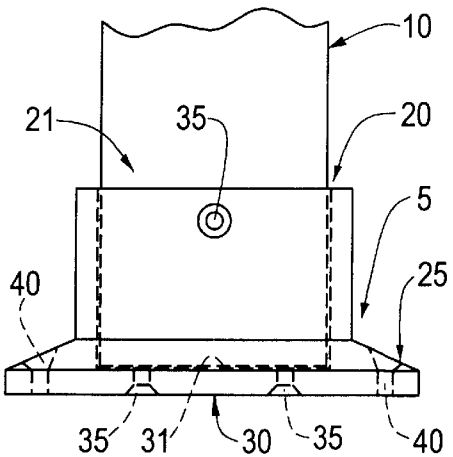
FIG. 3 is a side elevational view of the bracket shown in FIGS. 1 and 2.
Figure 1:
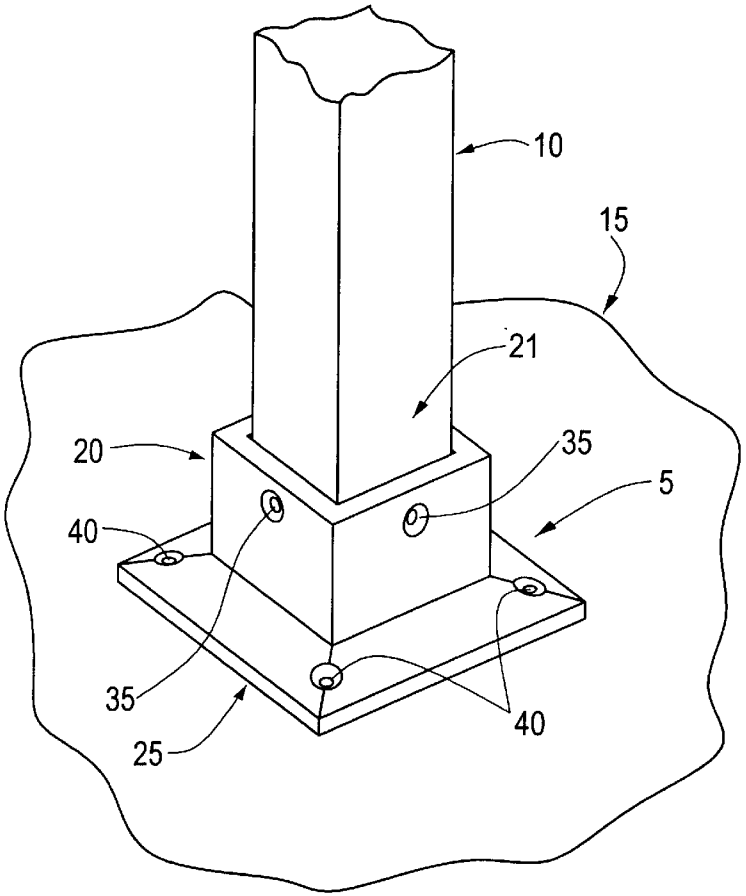
FIG. 1 is a perspective view showing an illustrative embodiment of bracket for mounting a post to a substantially flat surface.

Looking first at FIGS. 1–4, there is shown a first type of bracket 5 for mounting a post 10 to a substantially flat surface 15. Bracket 5 generally comprises a tubular wall portion 20 for receiving and surrounding the distal end 21 of post 10, and a flange portion 25 for seating against flat surface 15. Bracket 5 also comprises a web portion 30 (FIGS. 2–4) for engaging the distal end surface 31 of post 10 (FIG. 3). Openings 35 are formed in the bracket's tubular wall portion 20 and web portion 30 for receiving fasteners (such as nails or screws or the like) for securing bracket 5 to post 10. Openings 40 are formed in flange portion 25 for securing flange portion 25 to substantially flat surface 15. The exact number of openings 35 and openings 40 which are provided in bracket 5 will depend on the application. For many applications, it has been found that four openings 35 and four openings 40 work well, although more or less than that number may be provided. In fact, holes 35 may be provided only in tubular wall portion 20 and not in web 30, or they may be provided in web 30 and not in tubular wall portion 20, or they may be omitted altogether. It will be appreciated that, by securing post 10 to the bracket's tubular wall portion 20, and by securing the bracket's flange portion 25 to flat surface 15, post 10 will be effectively secured to flat surface 15.

Figure 5:
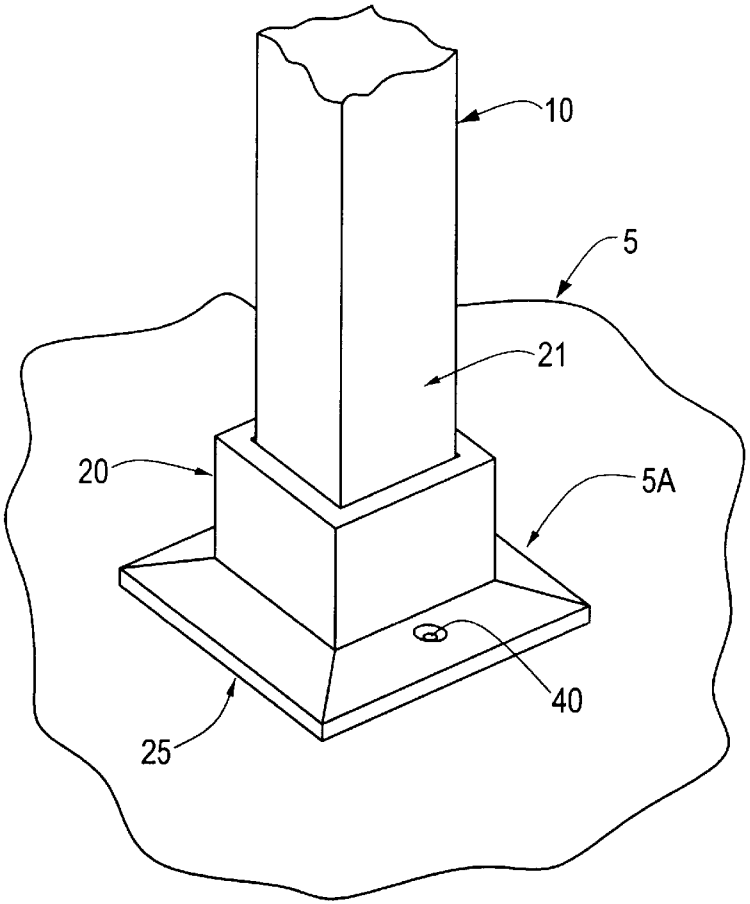
FIG. 5 is a perspective view of an alternative embodiment of bracket for mounting a post to a substantially flat surface.
Figure 4:
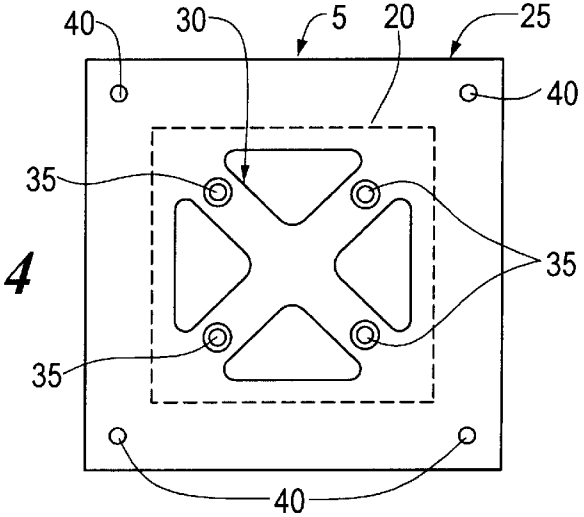
FIG. 4 is a bottom plan view of the bracket shown in FIGS. 1–3.
Figure 6:
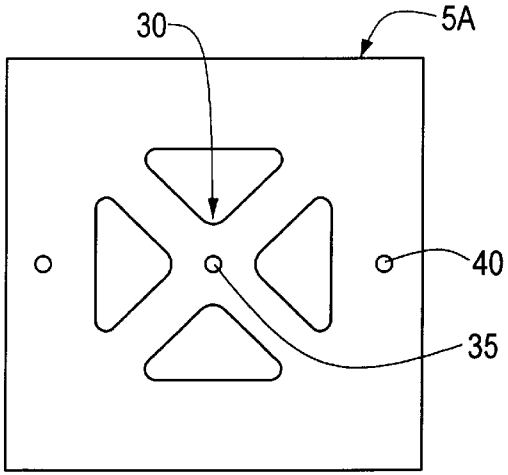
FIG. 6 is a bottom view of the bracket shown in FIG. 5.

Looking next at FIGS. 5 and 6, there is shown a second type of bracket 5A. Bracket SA is substantially the same as bracket 5 shown in FIGS. 1–4, except that with bracket 5A, openings 35 are omitted from the bracket's tubular wall portion 20, and openings 35 and openings 40 are disposed in different numbers and in locations about flange portion 25.

Figure 8:
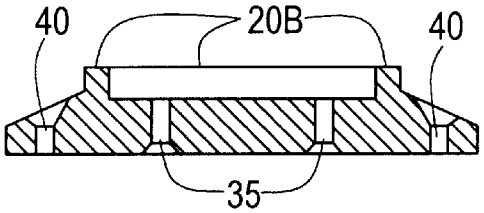
FIG. 8 is a sectional view taken along line 8—8 of FIG. 7.
Figure 7:
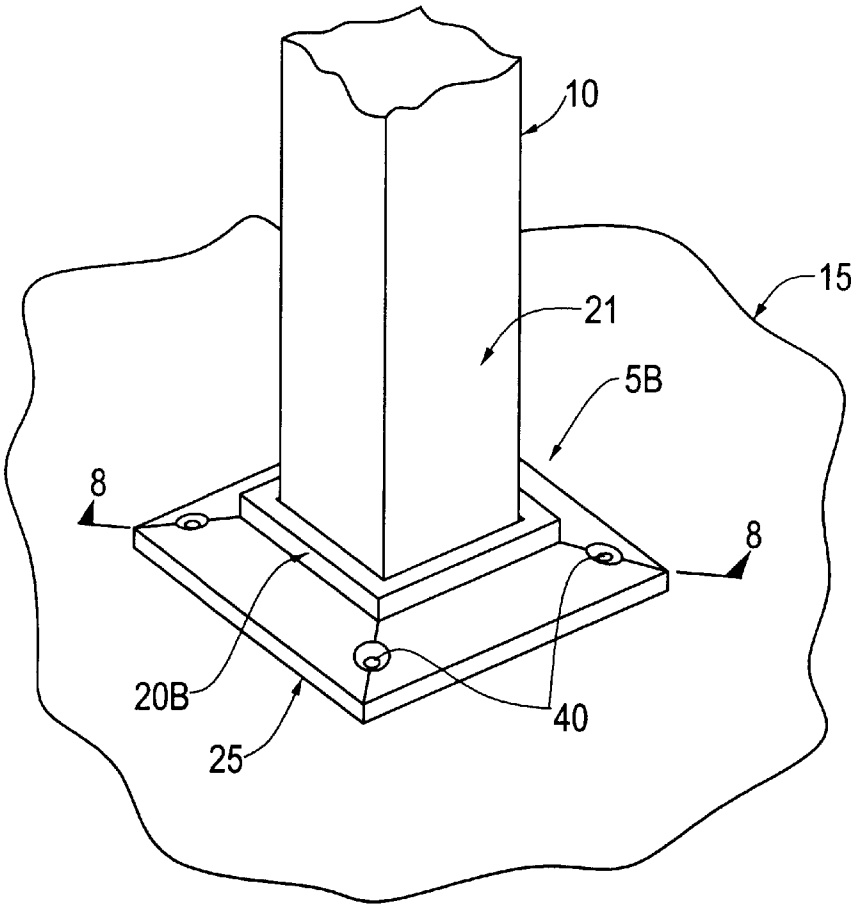
FIG. 7 is a perspective view of another alternative embodiment of bracket for mounting a post to a substantially flat surface.

Looking next at FIGS. 7 and 8, there is shown a third type of bracket 5B. Bracket 5B is substantially the same as bracket 5 shown in FIGS. 1–4, except that with bracket 5B, tubular wall portion 20B is much shorter than the tubular wall portion 20 provided for bracket 5, and tubular wall portion 20B lacks openings 35. In effect, in bracket 5B, tubular wall portion 20B comprises a shallow rib for stabilizing the distal end 21 of post 10 relative to bracket 5B.

Figure 8A:
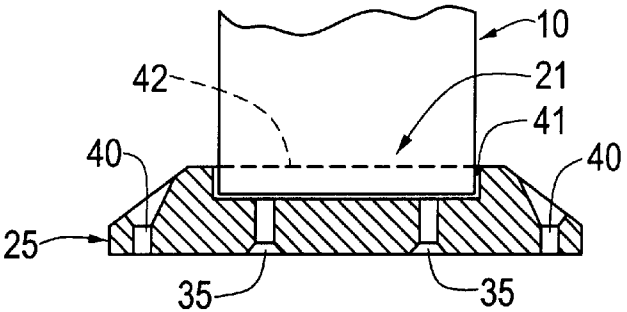
FIG. 8A is a view like that of FIG. 8, but showing another alternative form of bracket for mounting a post to a flat surface.

Alternatively, if desired, tubular wall portion 20B can be replaced by forming a corresponding sort of recess 41 (FIG. 8A) in the proximal surface 42 of the bracket's flange portion 25, with the recess being sized and shaped so as to receive and seat the distal end 21 of post 10.

Figure 10:
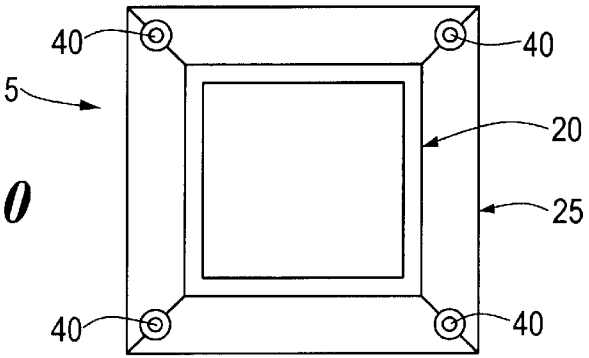
FIG. 10 is a top plan view of the bracket shown in FIG. 9.
Figure 9:
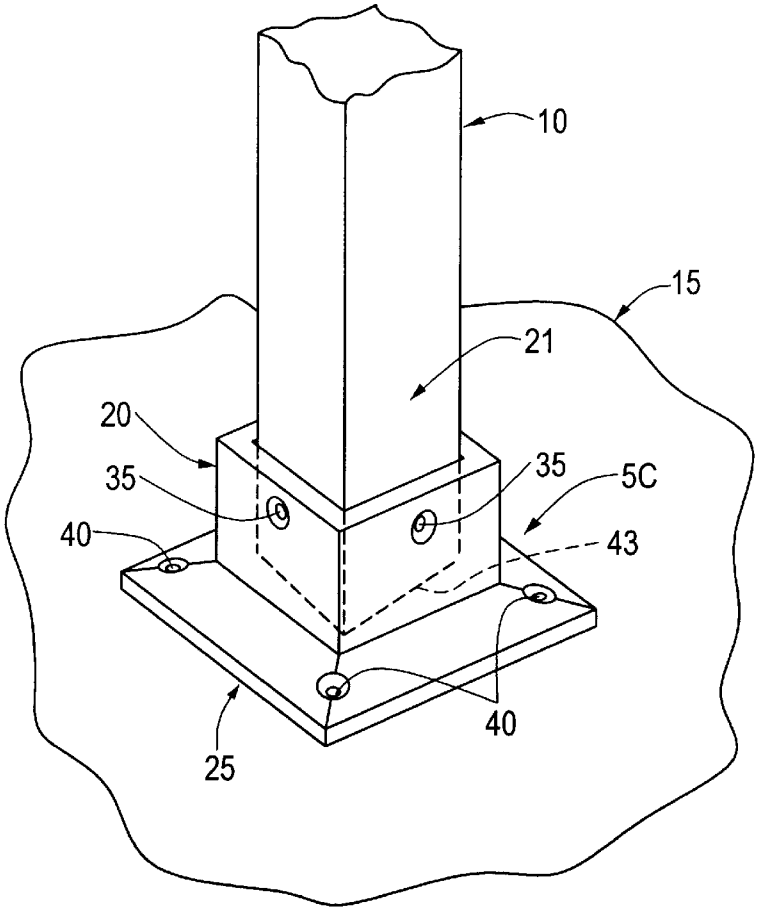
FIG. 9 is a perspective view of still another alternative embodiment of bracket for mounting a post to a substantially flat surface.

Looking next at FIGS. 9 and 10, there is shown a fourth type of bracket 5C. Bracket 5C is substantially the same as bracket 5 shown in FIGS. 1–4, except that with bracket 5C, web 30 is omitted entirely and the bracket's flange portion 25 simply surrounds the open distal end of tubular wall portion 20. This design can be advantageous where the distal end surface 43 of post 10 does not lie substantially perpendicular to the longitudinal axis of post 10, such as is schematically illustrated in FIG. 9.

The brackets shown in FIGS. 1–10 are preferably formed out of cast aluminum, although plastic, wood, steel, or any other rigid material can also be used to form the brackets.

Figure 11:
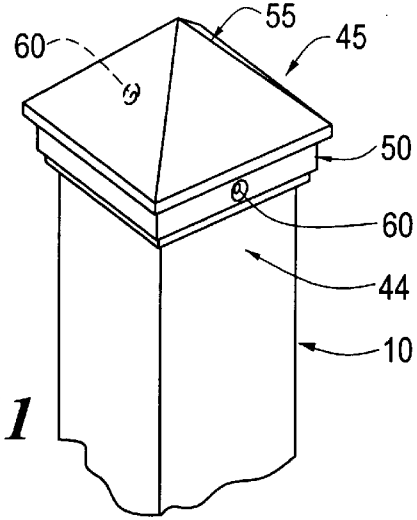
FIG. 11 is a perspective view of a post cap for capping the end of a post.

Looking next at FIG. 11, there is shown a post cap 45 for capping the top end of post 10. Post cap 45 comprises a wall portion 50 for fitting over a proximal end 44 of post 10, and an end portion 55 for closing off the proximal end of wall portion 50. Openings 60 are formed in wall portion 50 for receiving fasteners (such as nails or screws or the like) for securing post cap 45 to post 10. Post cap 45 is preferably cast as a single piece out of aluminum or some other satisfactory material, and surrounds the proximal end 44 of post 10 with a secure band of material so as to prevent the proximal end of the post from splitting.

Brackets generally similar to those heretofore described are particularly applicable to post and rail fences, and allow the fence rails to be placed at any height along the fence posts, and facilitate easy replacement of a bad or broken rail.

Figure 12:
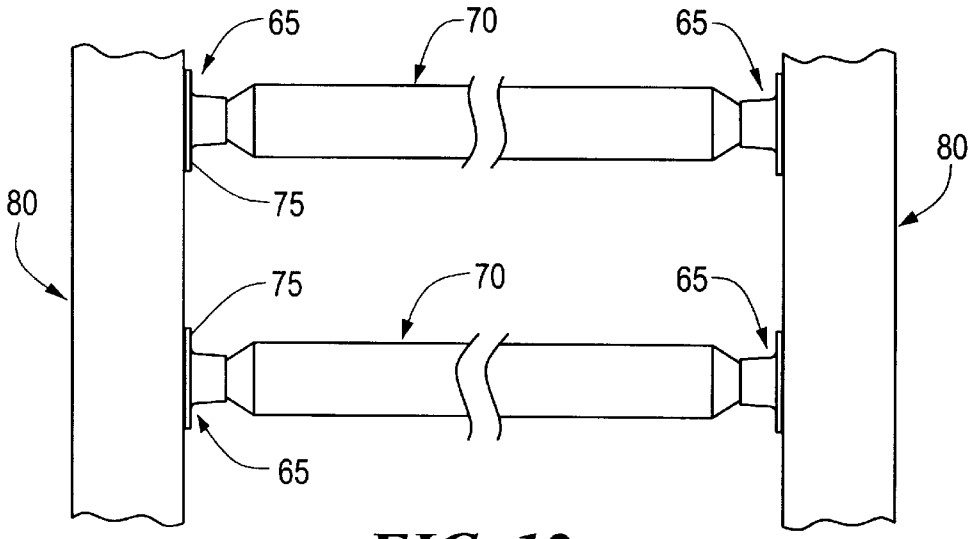
FIG. 12 is a front elevational view of another alternative embodiment of bracket, shown for mounting fence rails on posts.

More particularly, and looking now at FIG. 12, such brackets 65 may be attached to each end of a rail 70, and then the complete rail assembly slipped into place, without disturbing the posts 80 or the other rails 70. Then the brackets are nailed or screwed to the posts 80 at the desired height along the post.

Figure 13:
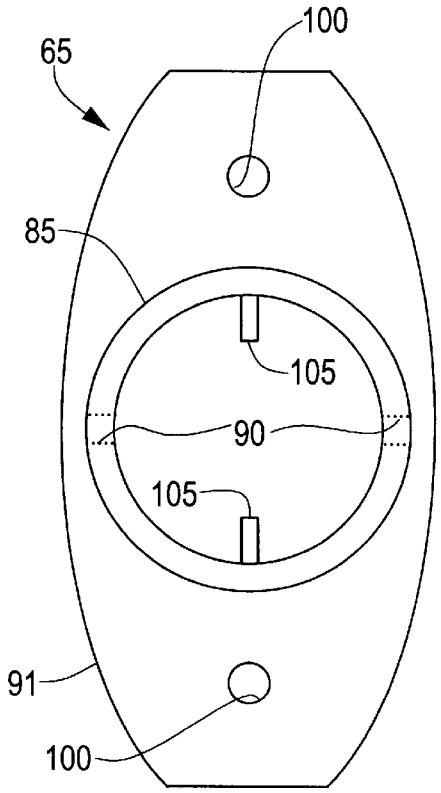
FIG. 13 is an end view of a bracket shown in FIG. 12.
Figure 14:
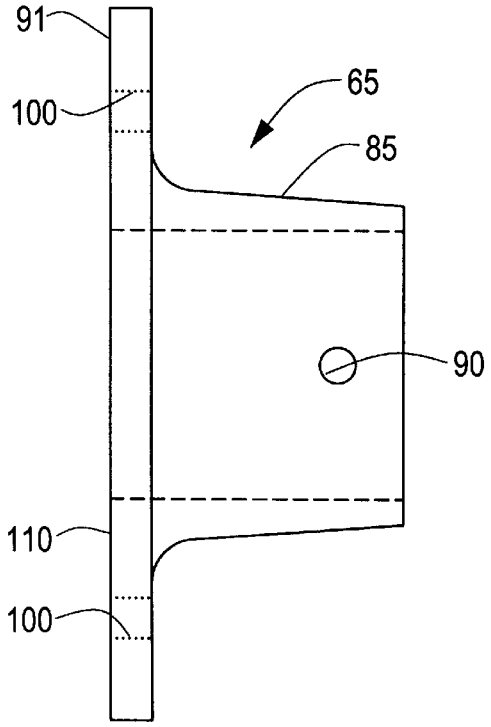
FIG. 14 is an enlarged side elevational view of the bracket of FIG. 13, with the bracket being modified slightly from the form shown in FIG. 13.

Looking now at FIGS. 12–14, post and rail bracket 65 may comprise a cylindrical portion 85 for receiving the end of rail 70. Holes 90 preferably are formed in cylindrical portion 85 whereby bracket 65 can be attached to rail 70. Bracket 65 also comprises the flange portion 91 for attachment to post 80. Holes 100 preferably are formed in flange portion 91 whereby flange portion 91 can be attached to post 80. The exact number of holes 90 and holes 100 which are provided in bracket 65 will depend on the fencing application. For many fencing applications, it has been found that two holes 90 and two holes 100 work well, although more or less than that number may be provided.

In one preferred embodiment, the post and rail bracket 65 is made of cast aluminum, but plastic, wood, steel, or any rigid material can also be used to form the bracket.

For a uniform appearance, brackets 65 should be used for the entire construction of the fence. However, if desired, brackets 65 can be used to replace one or more damaged rails in an existing fence.

One or more nails or screws (not shown) preferably are used to secure the bracket's cylindrical portion 85 to the rail end. One or more thin ribs 105 (FIG. 13) may be formed on the inner diameter of the bracket's cylindrical portion 85 to prevent rail 70 from rotating once it has been placed into bracket 65. Two or more nails or screws are preferably used to secure the bracket's flange portion 91 to post 80. Flange portion 91 of bracket 65 is typically provided with a flat back 110 (FIG. 14) for placement against post 80. Such an arrangement works well with rectangular posts and with many circular posts. However, if desired, flange portion 91 of bracket 65 may also be formed with a curved back (not shown) for use on round posts.

The present invention is also applicable to stockade-type fences of the type where vertical barrier members are hung on a post and rail skeleton. With such stockade-type fences, the present invention can be used to attach the skeleton rails to the skeleton posts (not shown), whereupon the remainder of the fence can then be mounted to the skeleton elements. It is to be appreciated that the mounting brackets of the present invention can be used with stockade-type fences for both initial construction purposes and/or repair purposes.

Figure 15:
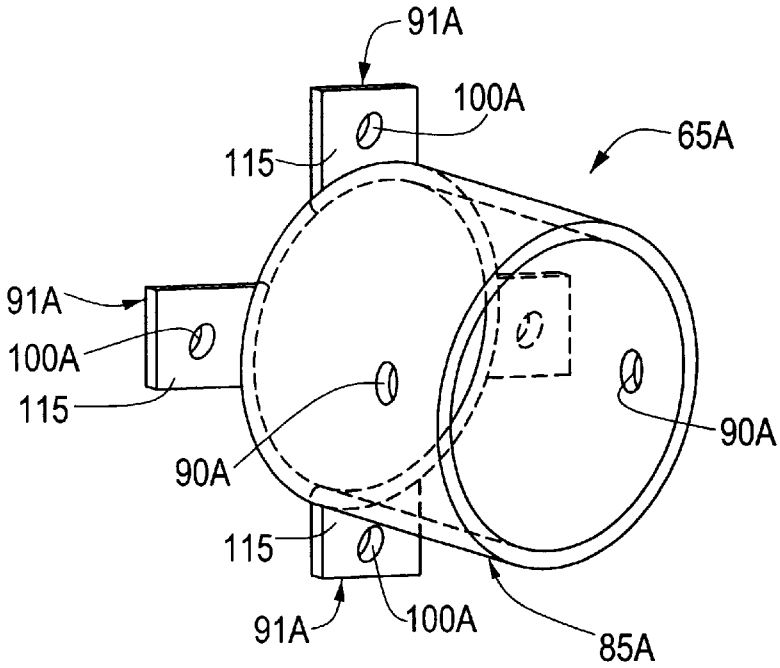
FIG. 15 is a perspective view of an alternative embodiment of bracket, somewhat similar to the bracket of FIG. 14 but showing a plurality of discrete flange members.

In FIG. 15 there is shown a bracket 65A which is similar to the bracket 65 shown in FIGS. 13 and 14, except that the flange portion 91A comprises a plurality of discrete flange members 115. Bracket 65A can have as many discrete flange members 115 as may be desired.

Figure 15A:
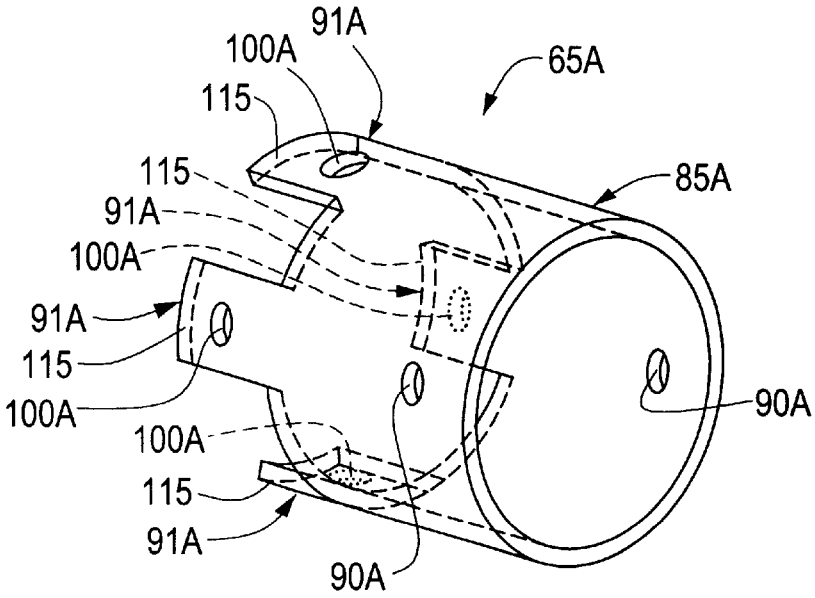
FIG. 15A illustrates how the bracket of FIG. 15 may be formed out of tubular stock.

As noted above with respect to bracket 65, bracket 65A can be formed out of a cast material such as aluminum or plastic. However, if desired, the bracket 65A shown in FIG. 15 can be formed out of tubular stock, such as in the manner illustrated in FIG. 15A. In this situation the discrete flange members 115 can be cut from the tubular stock and then bent outward at a right angle so as to form the desired structure.

Figure 15B:
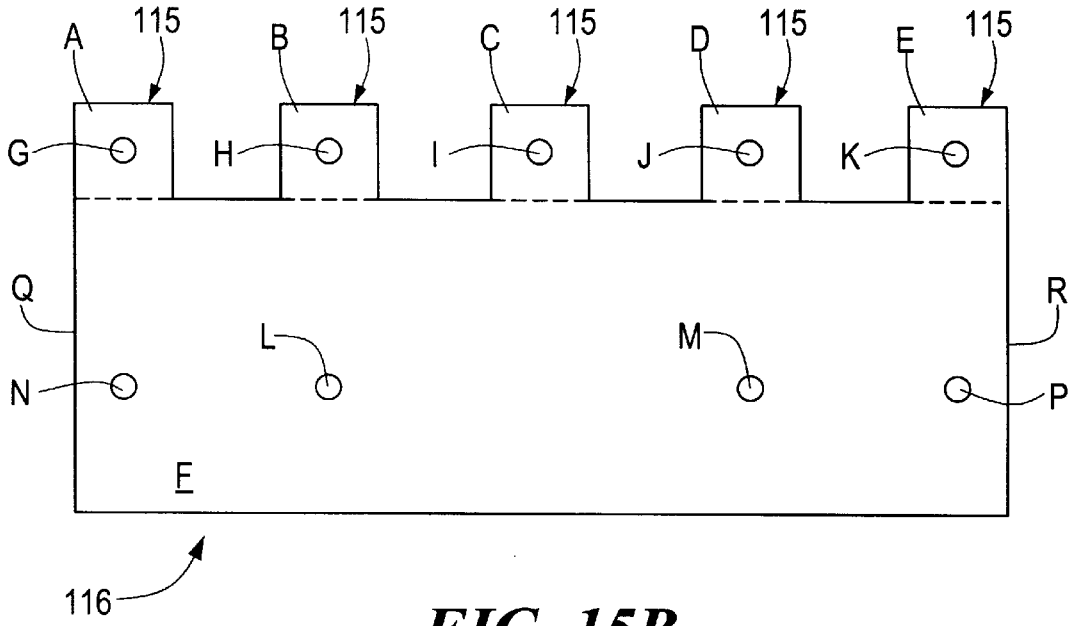
FIGS. 15B–15D illustrate how the bracket of FIG. may be formed out of stamped sheet stock.
Figure 15C:
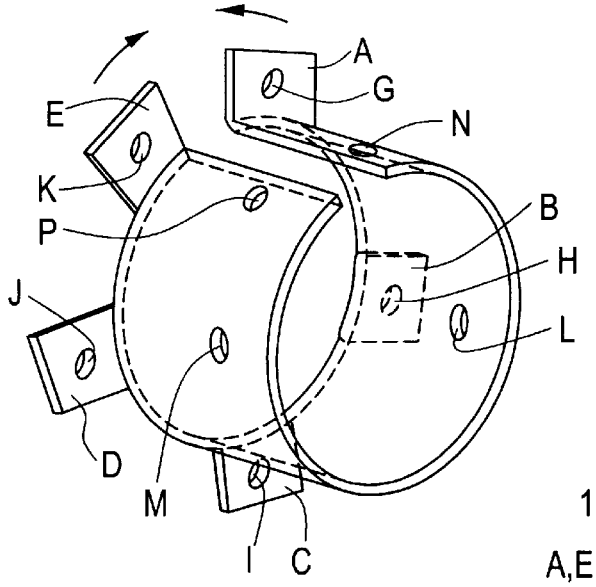
Figure 15D:
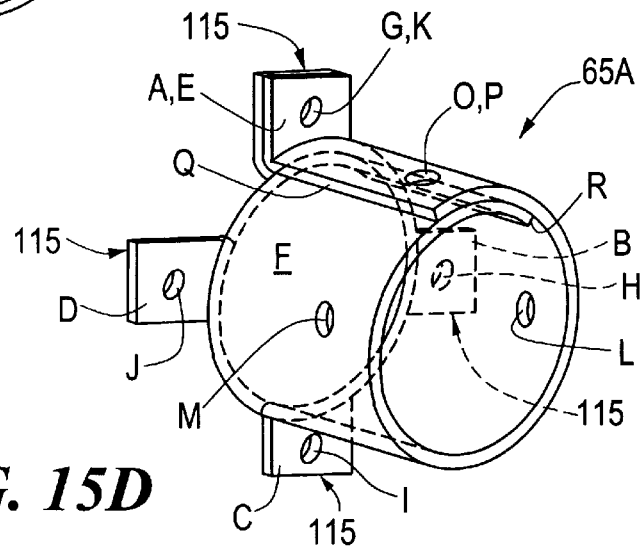

Alternatively, the bracket 65A shown in FIG. 15 can also be formed out of punched stock and then curled on itself so as to form bracket 65A. More particularly, and looking now at FIGS. 15B–15D, a flat part 116 (FIG. 15B) may be punched from a flat sheet of virgin metal stock, and then this flat part 116 curled (FIG. 15C) so that it forms the complete bracket 65A (FIG. 15D). In such a situation, where the bracket 65A is to have four flange members 115, five flanges 115 will preferably be formed on flat part 116, whereby one of the flanges 115 will overlie another of the flanges 115 on the assembled bracket 65A. Of course, it will also be appreciated that flange members 115 need not necessarily overlie one another when flat part 116 is curved into the bracket 65A, in which case only as many flange members 115 will be formed as the bracket 65A is to have.

Bracket 65A can also be formed with a rectangular cross-section is desired.

Figure 16:
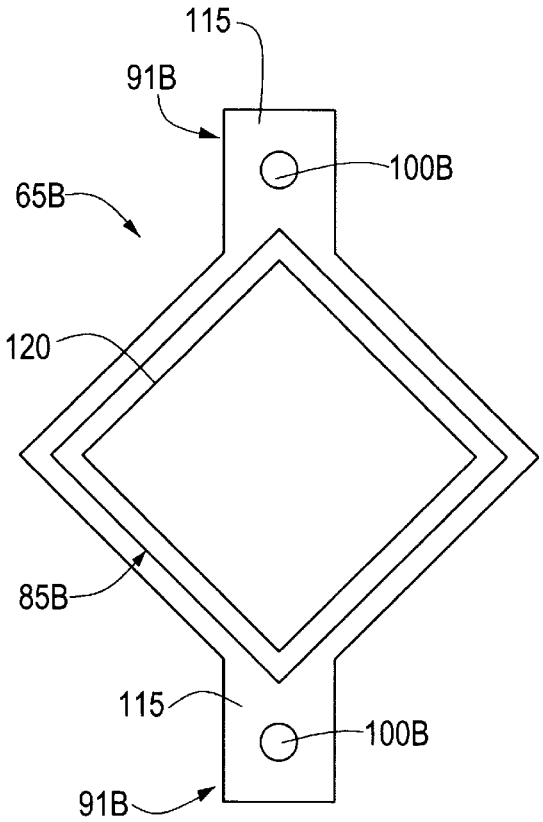
FIG. 16 is an end view of still another alternative embodiment of bracket for mounting fence rails on posts.
Figure 17:
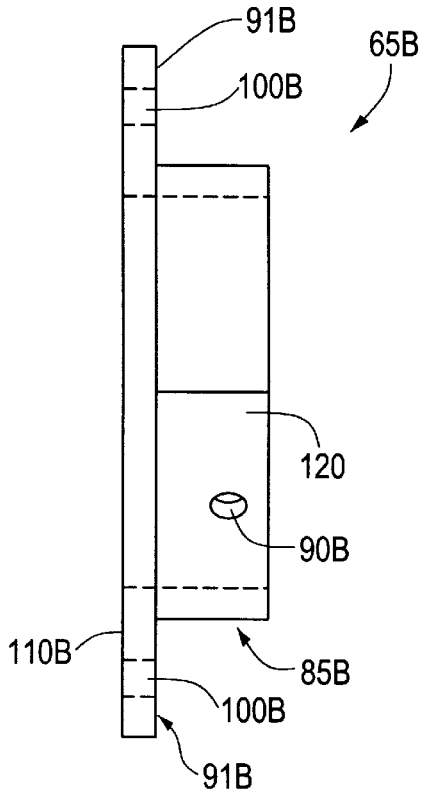
FIG. 17 is a side elevational view of the bracket of FIG. 16.

In FIGS. 16 and 17, there is shown a bracket 65B wherein the bracket is provided with a wall portion 85B defining a sleeve 120 which is rectangular rather than cylindrical, for receiving rectangular rails. If desired, wall portion 85 can be formed sufficiently large that the ends of the rails do not have to be tapered down to fit in the sleeve 120.

Figure 18:
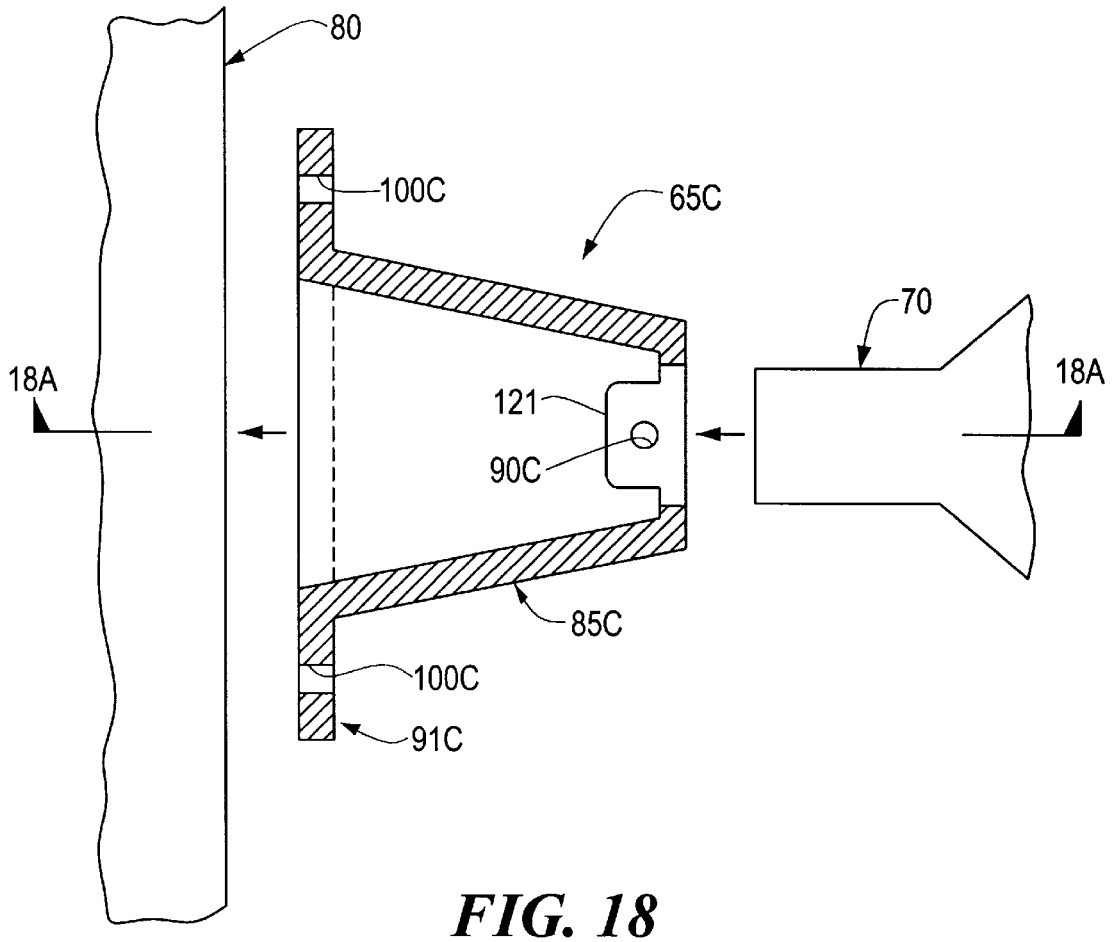
FIG. 18 is an exploded view of a fence post and rail arrangement, showing an alternative embodiment of bracket in centerline section and the post and rail in side elevation.

Referring to FIG. 18, it will be seen that bracket 65C may be provided with wall portion 85C of a frustoconical configuration, allowing rails 70 to extend from posts 80 at other than right angles. Thus, for example, rails may be angled from a post on relatively high ground to a post on relatively low ground. Alternatively, rails 70 can be angled to follow a curved path, e.g., about a circular driveway.

Figure 18A:
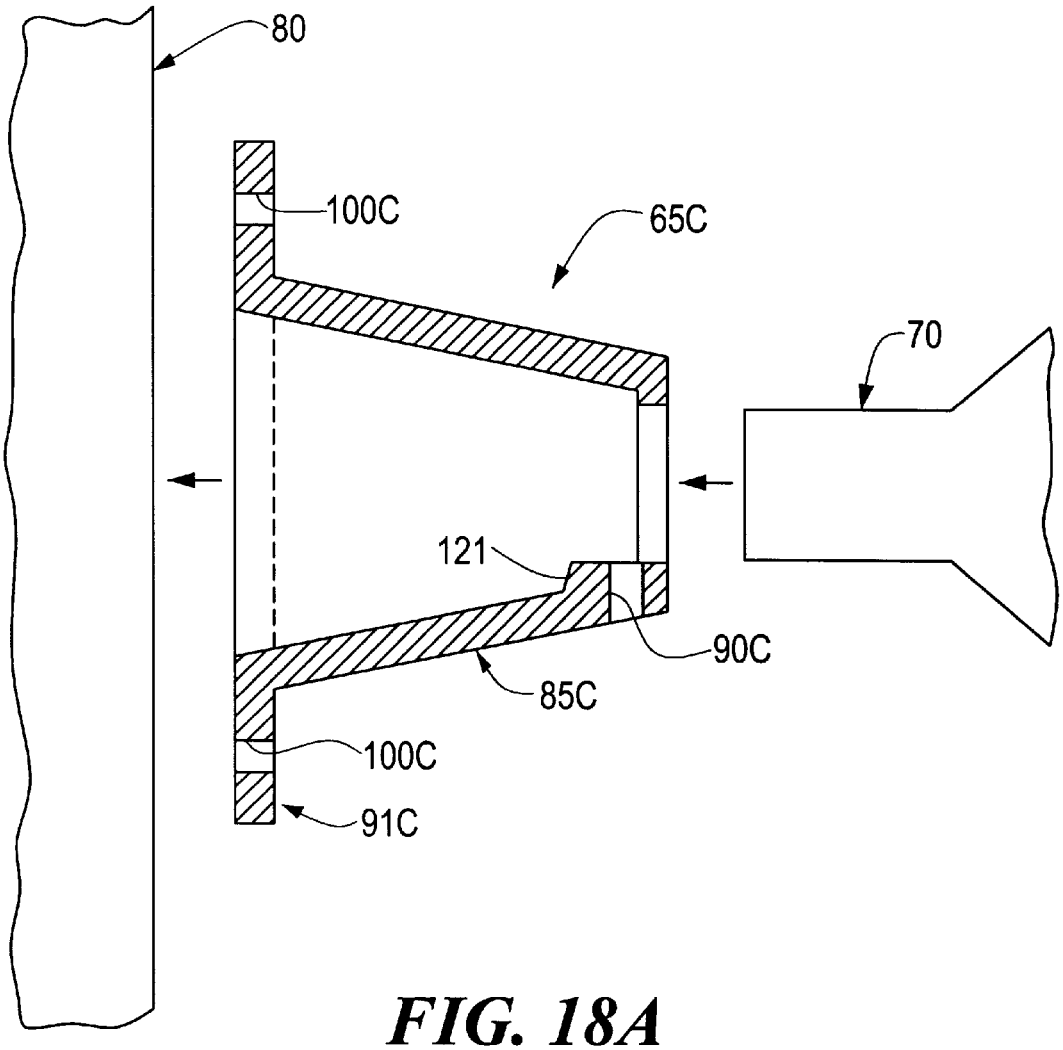
FIG. 18A is a sectional view taken along line 18A—18A of FIG. 18.

FIG. 18A illustrates how a side land 121 may be added to wall portion 85C to form a secure attachment to rails 70 about a hole 90C. More than one side land 121 may be provided if desired.

The conical shape of bracket 65C may also be utilized in others of the brackets formed in accordance with the present invention, e.g., it may be utilized in the bracket 5 shown in FIGS. 1–4.

Figure 21:
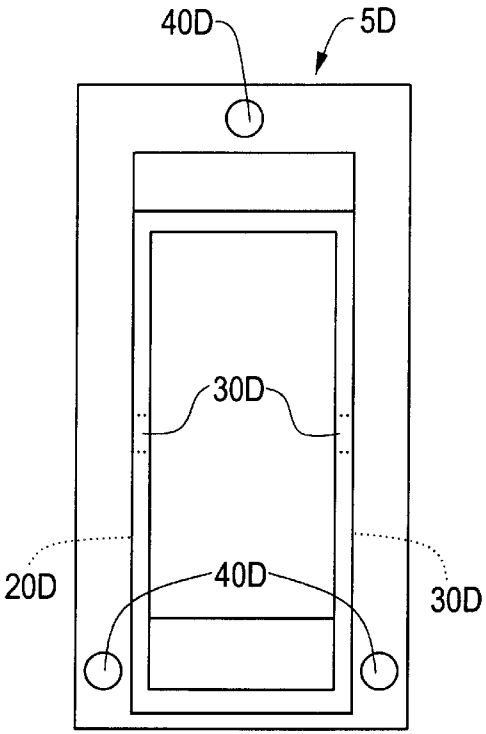
FIG. 21 is a front elevational view of the bracket shown in FIG. 20.
Figure 20:
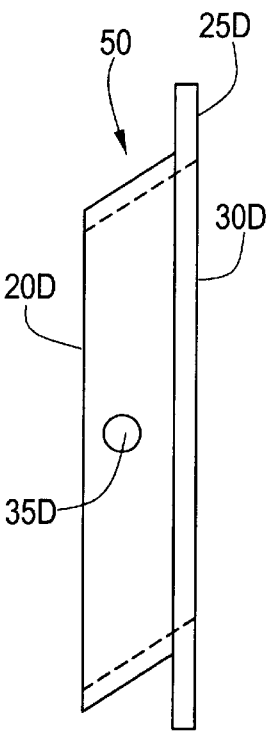
FIG. 20 is an enlarged side elevational view of a bracket of FIG. 19.
Figure 19:
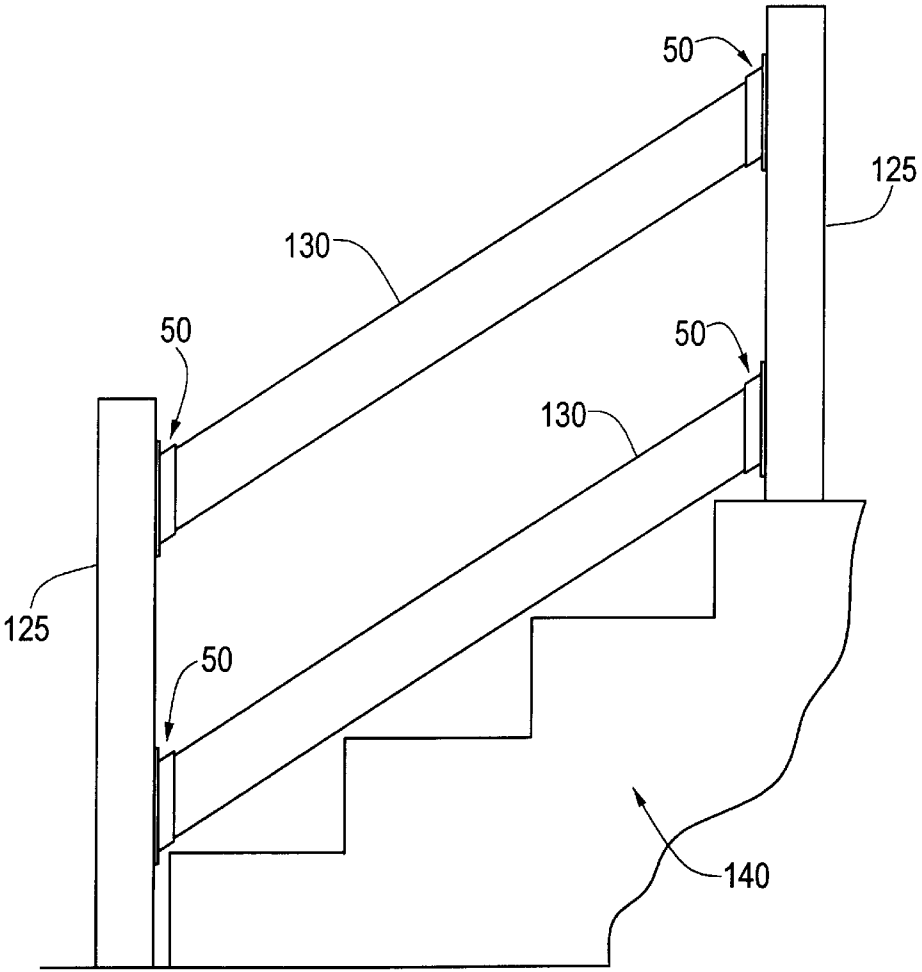
FIG. 19 is a side elevational view of a stair rail assembly including an alternative embodiment of bracket.

FIG. 19 discloses a stair rail assembly including stair rail posts 125 and stair rails 130 fixed to posts 125 by brackets 5D, shown in greater detail in FIGS. 20 and 21. Bracket 5D is similar to bracket 5 of FIGS. 1–4 except that its wall portion 20D is inclined from the plane of its flange portion 25D, permitting the rails 130 to follow the incline of the stairs 140. The web 30 of bracket 5 may or may not be incorporated in bracket 5D, as desired. FIG. 21 shows bracket 5D formed without a web 30. It should also be appreciated that brackets 50 may be positioned against vertical objects other than stair rail posts 125. By way of example, brackets 5D can be placed against the sides of buildings, trees, etc.

Figure 22:
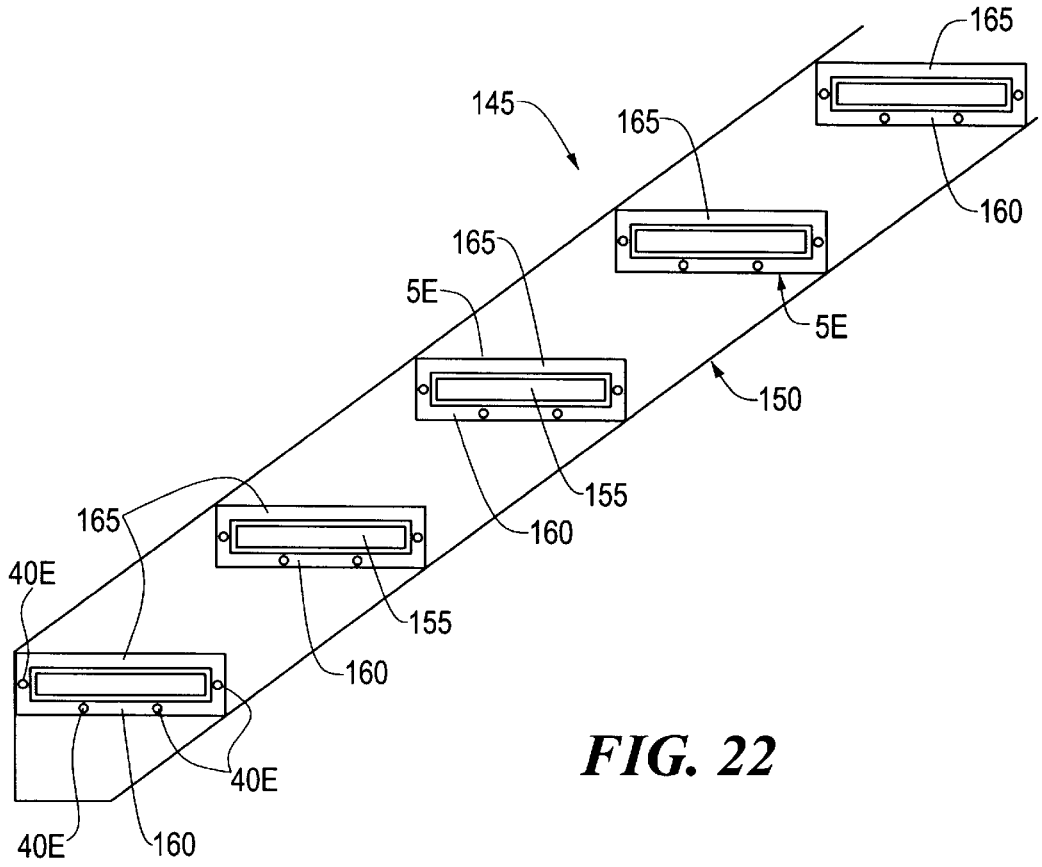
FIG. 22 is a side elevational view of a portion of a stair tread assembly including brackets similar to the bracket of FIG. 1, but somewhat modified.
Figure 23:
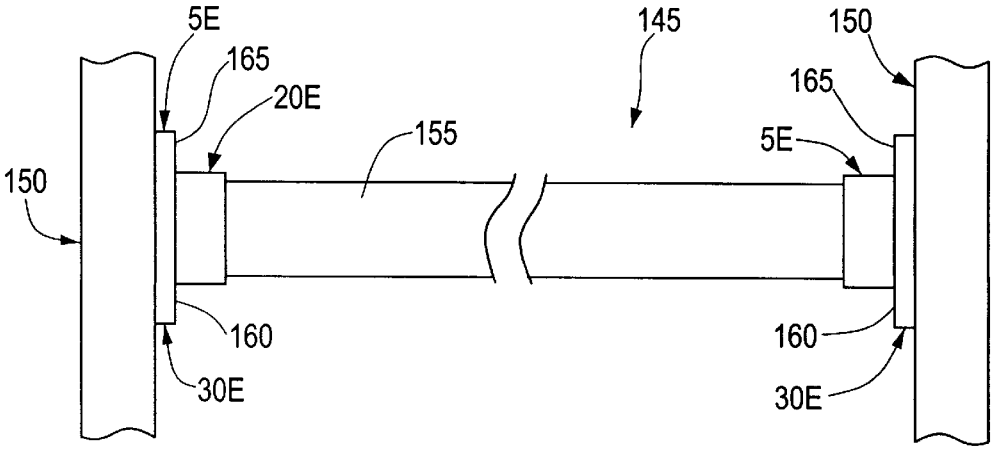
FIG. 23 is a front elevational view of a mounted stair tread and brackets as shown in FIG. 22.

In FIGS. 22 and 23, there is shown a stair tread assembly 145 including stringers 150 between which extend stair treads 155. The ends of each stair tread 155 are nested in brackets 5E which are similar to the bracket 5D of FIGS. 20 and 21, but in which the wall portion 20E extends normal to flange portion 30E. Brackets 5E are fixed to stringers 150 by screws or other fasteners which extend through holes 40E which extend through the flanges of the brackets.

Figure 24:
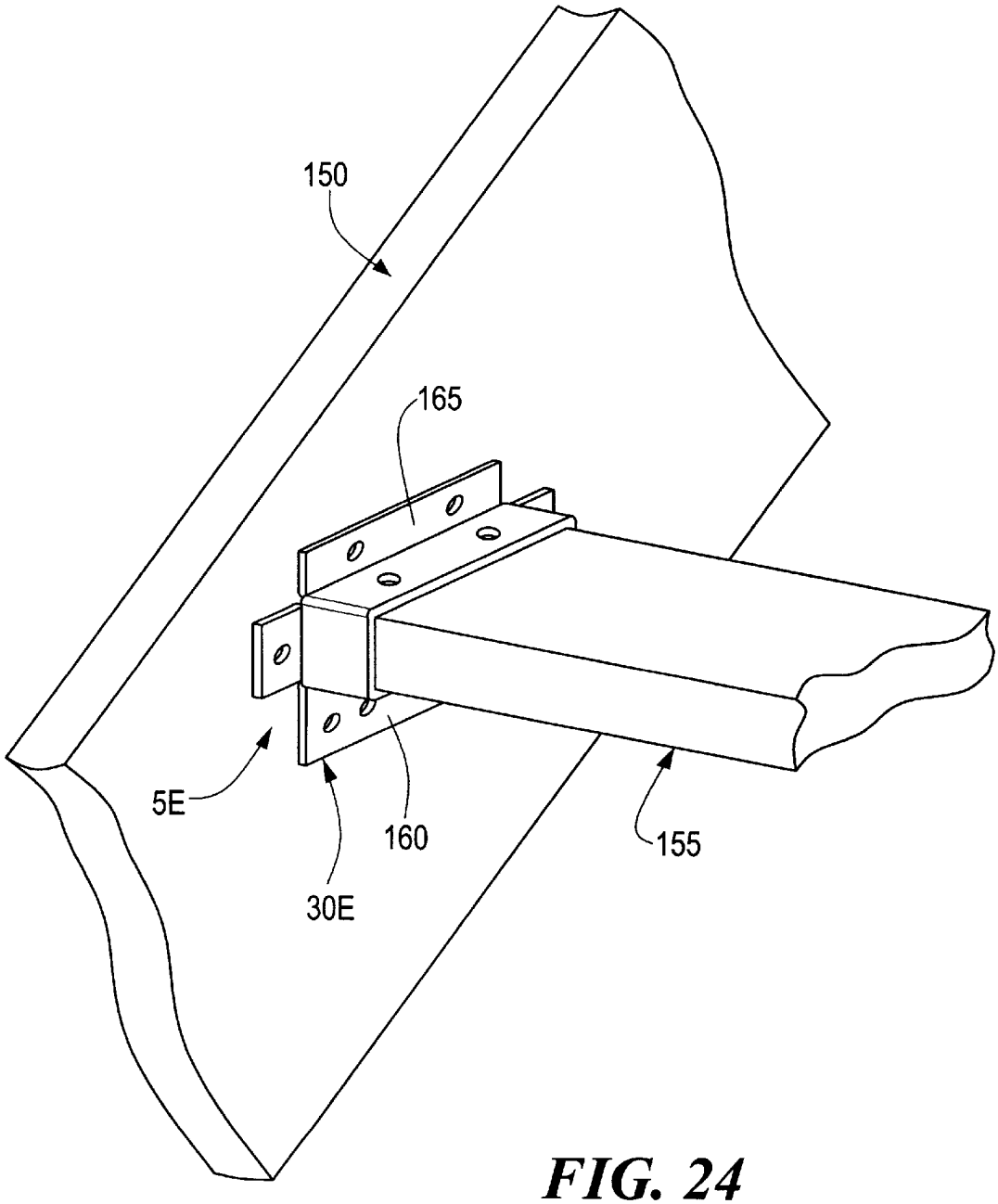
FIG. 24 is a partial schematic view of a portion of the stair tread assembly of FIGS. 22 and 23, but showing a modified form of bracket.

Preferably brackets 5E are formed out of a suitable cast material, e.g., cast aluminum, although they may also be fabricated in other ways consistent with the present invention, e.g., out of stamped metal which is appropriately bent into the desired shape. If desired, the bottom side 160 of flange portion 30E may be enlarged somewhat relative to the top side 165 of flange portion 30E, so that more screws or nails may be applied to the underside of the bracket and thereby provide improved attachment to the stringer 150. See, for example, FIG. 24, which shows a bracket 5E joining a stair tread 155 to a stringer 150, where bracket 5E is formed out of stamped sheet metal and where the bottom side 160 of the bracket's flange portion 30E is enlarged somewhat relative to the topside 165 of flange portion 30E.

There are thus provided several embodiments of brackets for interconnecting posts and horizontal surfaces, rails and posts, stair rails and stair rail posts, and staircase stringers and treads. While such uses of the brackets disclosed herein are of demonstrable value, it will be apparent to those skilled in the art that many uses not mentioned herein are within the scope of the invention, it being the thrust of the invention to provide brackets for fixing together two structural objects. Accordingly, the invention is by no means limited to the particular constructions herein disclosed and/or shown in the drawings, but also comprises any modifications or equivalents within the scope of the claims.

What is claimed is:

1. A bracket for mounting a post to a surface, said bracket being made of metal and comprising:

a tubular wall portion having a top end and a bottom end, said top end defining an opening through which a post can be inserted into said tubular wall portion, and said bottom end being closed off in part by a web that extends at a right angle to the longitudinal axis of said tubular portion, said web having a plurality of openings for receiving fasteners for securing said web to the end of said post that has been inserted into said tubular portion; and a flange portion formed integral with and surrounding said tubular wall portion at said bottom end, said flange portion having mutually spaced holes for securing said bracket to a surface.

2. A bracket according to claim 1 wherein said tubular portion has at least one side opening through which a fastener may be inserted for attachment to a post that has been inserted into said tubular portion.

3. A bracket according to claim 1 wherein said tubular portion has a rectangular cross-sectional configuration and said flange portion has a rectangular edge configuration.

4. A bracket according to claim 1 wherein said flange portion has a flat bottom surface that extends at a right angle to said tubular portion and a top surface that is inclined inwardly toward the center of said tubular portion away from said bottom surface, and further wherein said bottom end of said tubular wall portion is joined to said top surface of said flange portion.

5. A bracket made of metal for mounting a post to a surface, said bracket comprising:

a tube comprising a side wall that is continuous circumferentially so as to define an interior space, said tube having a top end with said interior space being open at said top end, said tube also having a bottom end and a web at said bottom end that extends across and partially closes off said interior space at said bottom end; and a flange formed integral with and surrounding said tube at said bottom end;

at least one of said tube and web having at least one hole for receiving a fastener for use in attaching said bracket to the end of a post residing in said tube, and said flange having a plurality of mutually spaced holes for receiving fasteners for securing said bracket to a surface.

6. A bracket according to claim 5 wherein said tube or said web has a plurality of holes for receiving fasteners for use in attaching said bracket to the end of a post residing in said tube.

7. A bracket according to claim 6 wherein said flange has a top surface and a flat bottom surface that extends at a right angle to said tube, and further wherein said web has a bottom surface that is coplanar with said flat bottom surface of said flange.

8. A bracket according to claim 7 wherein said web has a plurality of holes for receiving fasteners for securing said web to the end of a post residing in said tube.

9. A bracket according to claim 5 wherein said web comprises a plurality of arms that extend inwardly from said flange and are joined to one another centrally of said interior space.

10. A bracket according to claim 9 wherein said side wall has at least four sections arranged in a polygonal cross-sectional configuration, and said arms are radially aligned with the corners formed by said sections.

11. A bracket according to claim 9 wherein said side wall has four sections arranged in a rectangular cross-sectional configuration, and said arms total four with each arm radially aligned with a different one of the corners formed by said sections.

12. In combination with a flat surface and a post having opposite ends, a metal bracket for mounting said post to said surface, said bracket comprising:

a tube having a top end and a bottom end with one end of said post inserted into said tube through said top end, said bottom end defining an opening that is closed off in part by a web that extends at a right angle to the longitudinal axis of said tube, said tube having at least one side opening and said web having at least one access hole for a fastener;

a flange formed integral with and surrounding said tube at said bottom end, said flange having a plurality of mutually spaced holes;

at least one fastener for securing said tube to said one end of said post, said at least one fastener extending through said at least one side opening or through said at least one access hole, whereby to secure said bracket to said post; and additional fasteners extending through said mutually spaced holes in said flange into said surface, whereby to anchor said bracket and post to said surface.

13. The combination according to claim 12 wherein said web comprises a plurality of radially extending arms with openings between said arms.

14. The combination according to claim 12 wherein said tube and said post have rectangular cross-sectional configurations.

* * * * *